US007150129B2

(12) United States Patent
Elder et al.

(10) Patent No.: US 7,150,129 B2
(45) Date of Patent: Dec. 19, 2006

(54) MODULAR STEP SYSTEM FOR POOLS

(75) Inventors: Charles R. Elder, Averill Park, NY (US); Thomas E. Lucas, Clifton Park, NY (US); Peter G. Moran, Sr., Saratoga Springs, NY (US); Donald Nicoll, Clifton Park, NY (US)

(73) Assignee: Latham Plastics, Inc., Scotia, NY (US)

( * ) Notice: Subject to any disclaimer, the term of this patent is extended or adjusted under 35 U.S.C. 154(b) by 0 days.

(21) Appl. No.: 11/282,807

(22) Filed: Nov. 18, 2005

(65) Prior Publication Data

US 2006/0117681 A1 Jun. 8, 2006

Related U.S. Application Data

(60) Provisional application No. 60/629,542, filed on Nov. 19, 2004.

(51) Int. Cl.
*E04F 11/00* (2006.01)

(52) U.S. Cl. ..... 52/184; 52/6; 52/8; 52/182; 4/506; 4/488; 4/496

(58) Field of Classification Search ..... 52/182, 52/184, 6, 8; 4/496, 506; 182/93, 94, 194
See application file for complete search history.

(56) References Cited

U.S. PATENT DOCUMENTS

| | | | | |
|---|---|---|---|---|
| 3,848,378 | A | 11/1974 | Witte | |
| 4,589,237 | A | 5/1986 | Dahowski | |
| 4,596,096 | A * | 6/1986 | Heath | 52/6 |
| 5,186,874 | A * | 2/1993 | McLaughlin | 264/35 |
| 5,644,873 | A * | 7/1997 | Bourgault | 52/182 |
| 5,794,391 | A * | 8/1998 | Howard | 52/182 |
| 5,916,098 | A | 6/1999 | Crelin | |
| 5,941,030 | A * | 8/1999 | Williamson | 52/182 |
| 6,543,191 | B1 * | 4/2003 | Kress | 52/182 |
| 6,966,405 | B1 * | 11/2005 | St-Pierre et al. | 182/93 |

* cited by examiner

*Primary Examiner*—Naoko Slack
*Assistant Examiner*—Yvonne M. Horton
(74) *Attorney, Agent, or Firm*—Wolf Block Schorr & Solis-Cohen LLP

(57) ABSTRACT

A modular step system for in-ground swimming comprising a bottom central hub, a brace assembly, a top central hub, a tread support assembly, a step form and a liner. The components of the modular step system interlock and snap together without fasteners. Also, the components of the modular step system are obtained by molding plastic material or curing of a curable material. The modular step system is installed on a level concrete floor of a swimming pool and designed to be rigidly fixed from behind to adjacent pool walls. The modular step system is adaptable to a pool having a vinyl liner, structurally sound regardless of size, easy to assemble, consistent in size, and cost-effective.

19 Claims, 13 Drawing Sheets

MODULAR STEP SYSTEM FOR POOLS

PRIORITY

This application claims benefit of U.S. Provisional Patent Application No. 60/629,542, filed Nov. 19, 2004.

FIELD OF THE INVENTION

The present invention generally relates to interior steps in swimming pools, and in particular, to a modular step system for in-ground swimming pools.

BACKGROUND OF THE INVENTION

Presently, it is relatively common to use various types of interior steps or stairs in a swimming pool for swimmers to gain access to and exit the swimming pool. A well recognized style of interior steps is known as a "wedding cake" step form. In certain types of swimming pools, such as ones constructed of concrete or gunite, permanent interior steps are often built on site by constructing a step form. The step form is filled with concrete, and when the concrete has set and dried, the step form is removed. The cost of manufacturing concrete steps is expensive and labor intensive, requiring highly skilled workers for construction. However, a concrete step is advantageous for concrete or gunite type pools and when there is a need for variations in the step shape or size.

However, a problem is presented when concrete steps are used for vinyl liner type swimming pools. With these types of pools, it is difficult to accurately measure and build a conforming liner to cover the concrete steps due to the variability and the unique shapes and sizes of poured concrete steps.

As an alternative to poured concrete steps, one-piece molded plastic steps have been designed and used. However, one-piece molded plastic step designs have minimal structure to support the weight of swimmers and water pressure forces. As a result, one-piece molded plastic steps have size limitations and do not perform well when covered with a vinyl liner.

Therefore, for the reasons stated above, there is currently a need for a plastic step system that is adaptable to a pool having a vinyl liner, structurally sound regardless of size, easy to assemble, consistent in size, and cost-effective; such as that provided by the present invention described herein.

OBJECTS AND SUMMARY OF THE INVENTION

It is therefore an object of the present invention to provide a modular step system that overcomes the shortcomings of prior art systems.

It is another object of the present invention to provide a modular step system that may be used with new or existing pools.

It is further object of the present invention to provide a modular step system that may be used with a pool having a vinyl liner.

It is yet another object of the present invention to provide a modular step system which is not labor intensive, not expensive and does not require a skilled workman to assemble.

It is another object of the present invention to provide a modular step system that permits steps to be consistently molded and easily fabricated.

It is a further object of the present invention to provide a modular step system that has adequate structure, strength and may support the weight of swimmers and water pressure forces.

It is still a further object of the present invention to provide a modular step system that may be used with steps having variability in sizes and shapes such as for pools with flat, corner, or curved walls.

In accordance with the above objectives, the present invention provides a modular step system for in-ground swimming pools including a bottom central hub, a brace assembly, a top central hub, a tread support assembly, a step form and a liner. The components of the modular step system interlock and snap together without fasteners. The modular step system is installed on a level concrete floor of a swimming pool and designed to be rigidly fixed from behind to adjacent pool walls. Typically, the modular step system comprises a bottom step closest to the floor of the swimming pool, a top step closest to a surface of water at a top of the swimming pool and a middle step located between the bottom step and the top step.

During assembly of the modular step system, the bottom central hub is placed at an intersection of the level concrete floor and a pool wall of the pool, at a desired center point of where the modular step system will be installed. The bottom central hub includes a plurality of hub notches facing up for securely fastening the brace assembly described herein.

The brace assembly comprises a plurality of braces which are vertical support members inserted into the bottom central hub. Each brace includes a bottom brace notch, a bottom groove, a middle groove and a top groove. Each brace also includes tabs for engaging the bottom central hub and the top central hub. The plurality of braces are inserted into the bottom central hub so that each hub notch engages a brace. The brace assembly provides sufficient support to the modular step system and eliminates the need for building forms and ordering and pouring concrete.

After the plurality of braces have been inserted into the bottom central hub, the top central hub is placed at a top central point of the plurality of braces. The tabs of the plurality of braces are inserted into the plurality of hub notches of the top central hub to create a rigid structure to support the step form. The top central hub stabilizes and aligns the brace assembly and serves to transmit forces carried by the brace assembly into the adjacent pool wall.

A plurality of toe braces are thereafter inserted into the bottom brace notch and engage the plurality of braces. The toe brace is a horizontal support brace which is located at the base of the modular step system near the bottom step.

The tread support assembly comprises horizontal rigid members mounted to the brace assembly to secure the brace assembly into its vertical position. The tread support assembly includes a bottom tread, a middle tread and a top tread and forms the bottom step, middle step and top step, respectively. The bottom tread is securely engaged to the bottom groove via openings which mate with posts, respectively, on the bottom groove of the tread. Similarly, the middle tread is engaged to the middle groove and the top tread is engaged to the top groove in the same manner. The tread support assembly carries the downward vertical forces of water in the swimming pool and of a swimmer on the modular step system, thereby transferring the forces to the brace assembly and onto the floor of the swimming pool.

The step form is placed over the structure comprising the bottom central hub, the brace assembly, the top central hub, the tread support assembly, and the toe brace. The step form is preferably made of a molded plastic material or curing of a curable material and produced from a fixed mold. The step form is molded with a textured pattern in the tread assembly area (i.e. on the steps) creating a non-slipping surface to reduce slipping on the modular step system.

The step form must be fully seated against the pool wall, the concrete floor, and have a close fit with the brace assembly and the tread support assembly. The step form may be covered with the liner preferably made of vinyl. The liner is fabricated and placed over the step form in conformance with the appearance of the vinyl liner in the swimming pool. The textured pattern of the step form engages and presses through the liner so that the liner also includes a textured pattern, thereby reducing the slippery surface of the smooth vinyl when it is covered by water and stepped on by a swimmer. By creating the step form from a fixed mold, the liner consistently fits the structure, without the need for adjusting and re-measuring the step.

The modular step system may also be designed to be placed in a 90-degree pool corner and a pool wall having a concave curve. The modular step system and the pool corner or concave pool wall have conforming shapes and curves. The components of the modular step system are obtained by molding plastic material or curing of a curable material.

BRIEF DESCRIPTION OF THE DRAWINGS

A more complete appreciation of the present invention and many of the attendant advantages thereof will be readily understood by reference to the following detailed description when taken in conjunction with the accompanying drawings, in which.

DETAILED DESCRIPTION OF THE INVENTION

Figure 1:
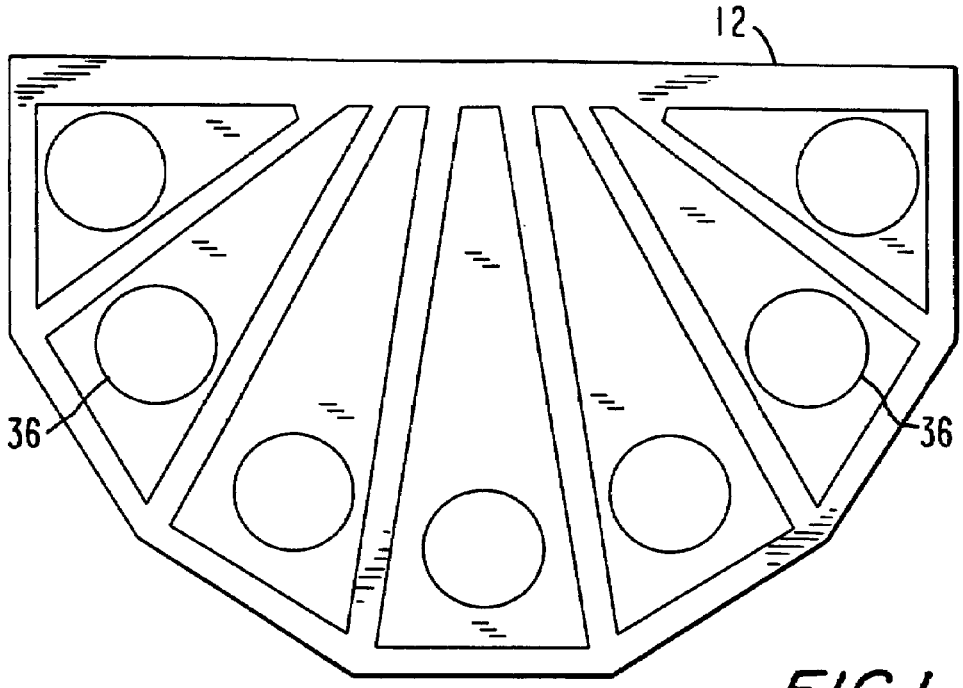
FIG. 1 is a top view showing a hub of a first embodiment of a modular step system according to the present invention.

The invention will now be described with reference to FIGS. 1 to 16, which in general discloses a modular step system for in-ground swimming pools. In the figures, like reference characters designate identical or corresponding parts throughout the several views.

Figure 9:
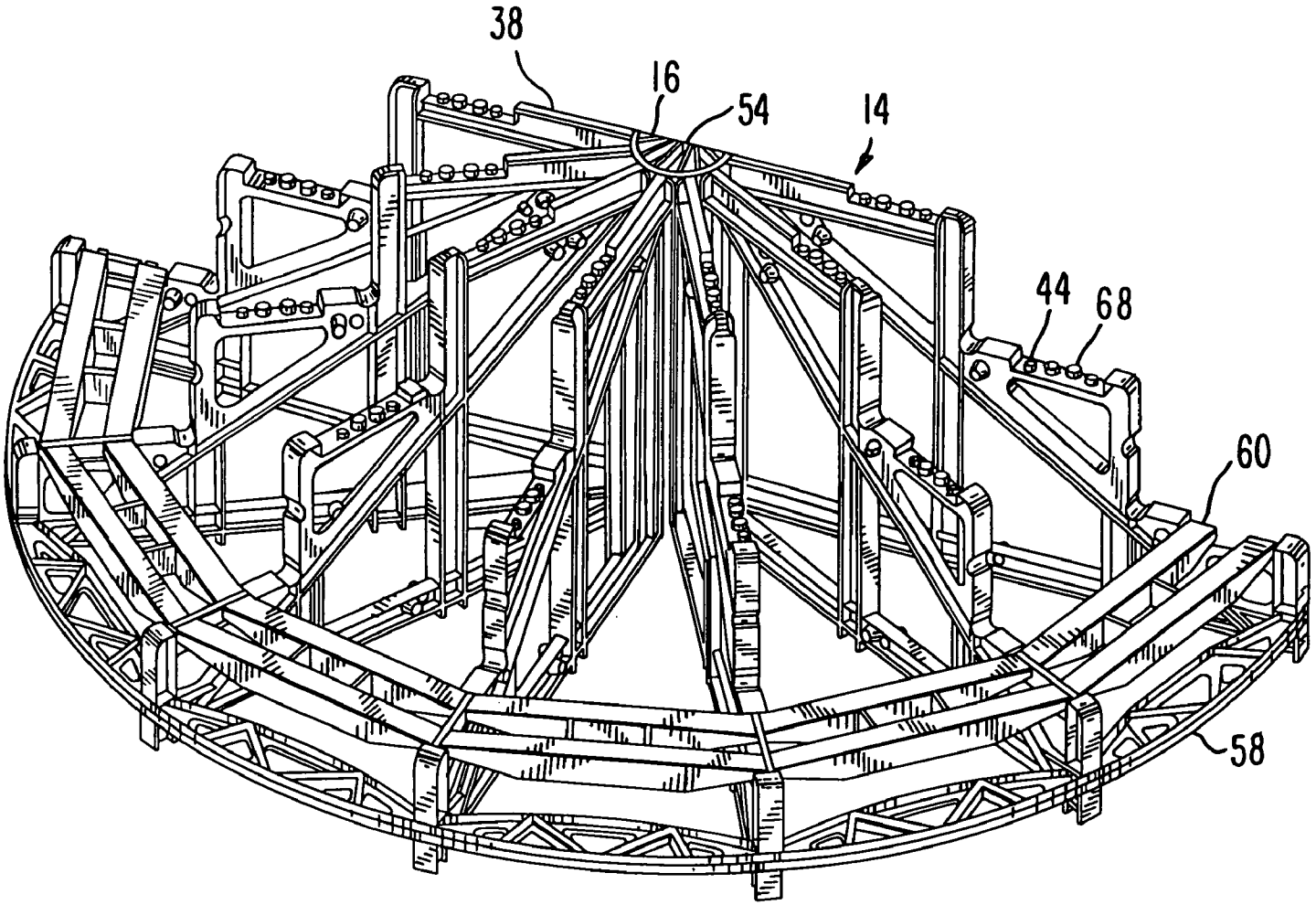
FIG. 9 is a perspective view showing a plurality of braces inserted into a top hub with the toe brace and a bottom tread secured to the plurality of braces of the first embodiment of the modular step system according to the present invention.
Figure 10:
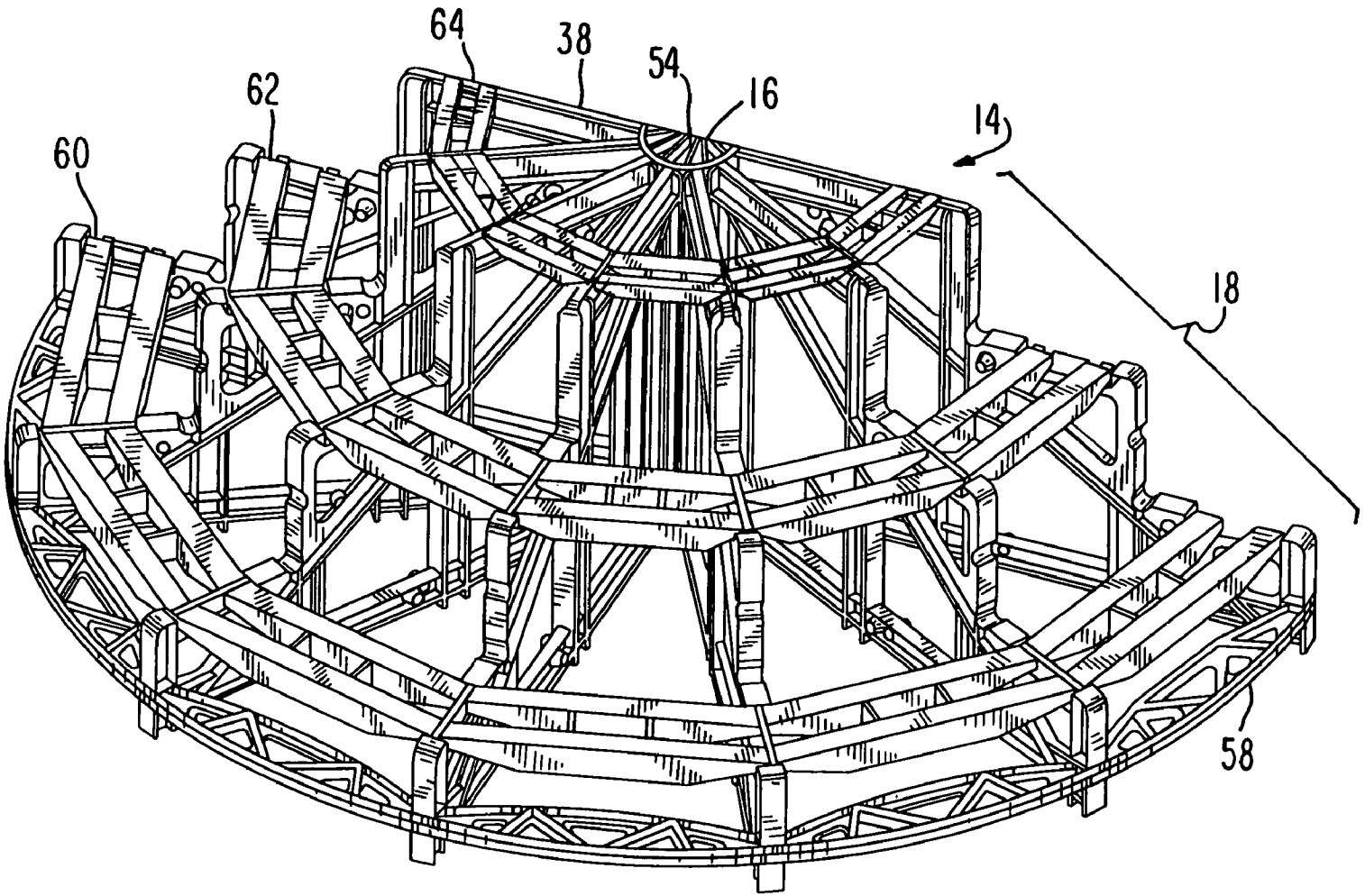
FIG. 10 is a perspective view showing a plurality of braces inserted into a top hub with the toe brace, the bottom tread, the middle tread and the top tread secured to the plurality of braces of the first embodiment of the modular step system according to the present invention.
Figure 11:
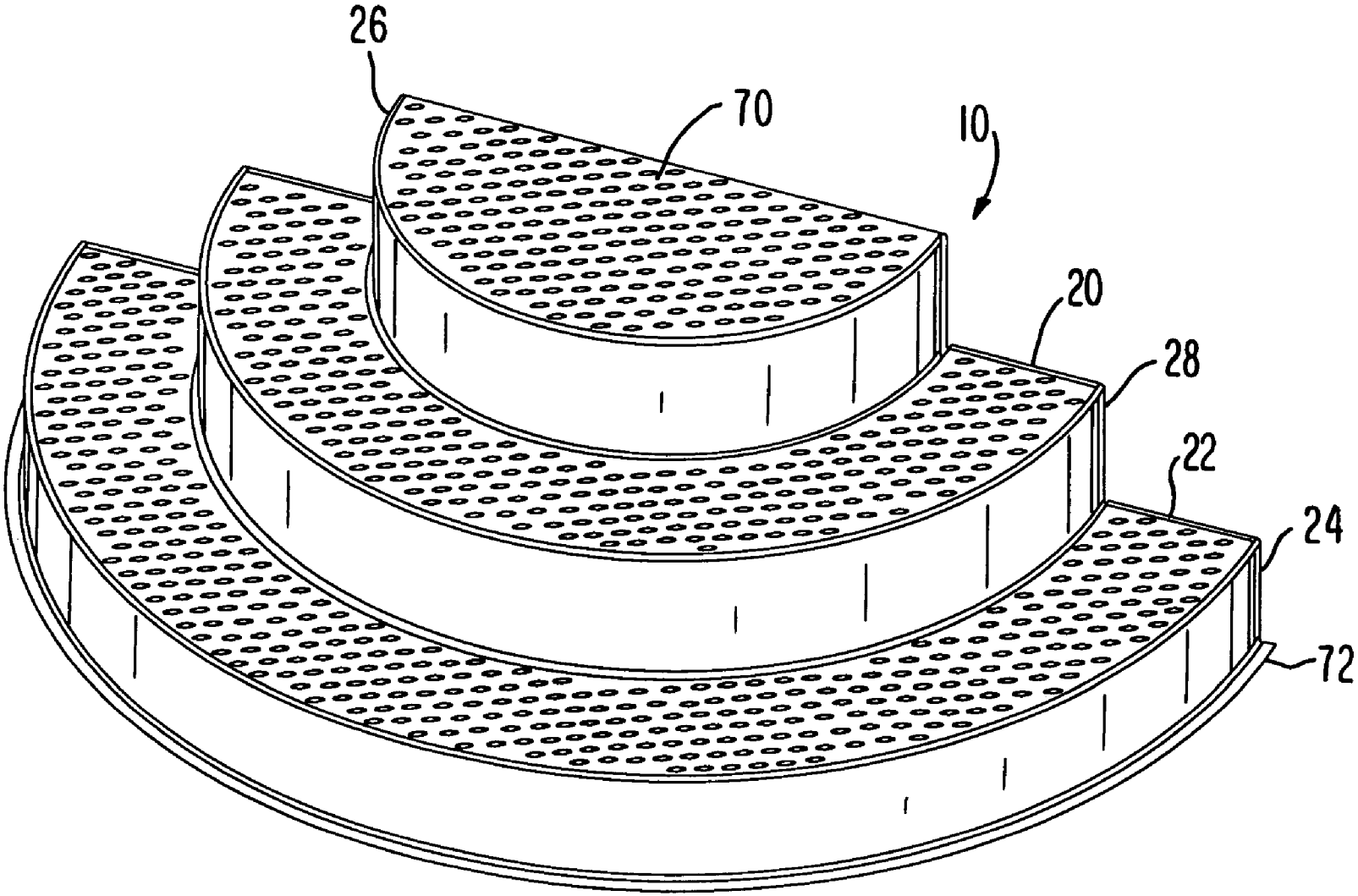
FIG. 11 is a perspective view showing a step form of the first embodiment of the modular step system according to the present invention.
Figure 12:
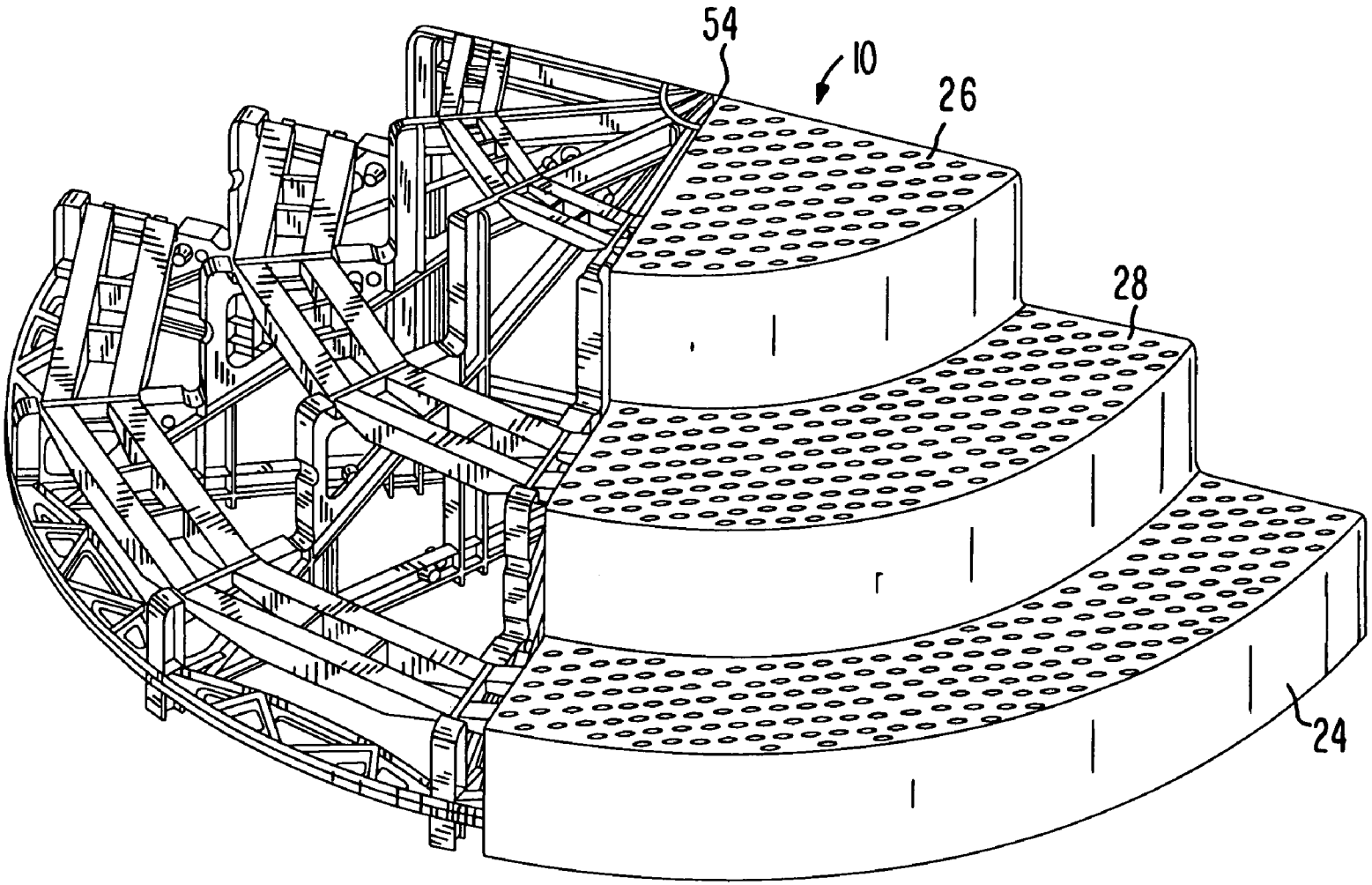
FIG. 12 is a perspective view showing a cut-away of the step form and the braces and treads of the first embodiment of the modular step system according to the present invention.

Referring now to FIGS. 1 to 12, a modular step system for in-ground swimming pools in accordance with the first embodiment of the present invention is identified generally by reference numeral 10 shown in FIGS. 11 and 12. The modular step system 10 includes a bottom central hub 12, a brace assembly 14, a top central hub 16, a tread support assembly 18, a step form 20 and a liner 22. The components of the modular step system interlock and snap together without fasteners. The modular step system 10 is installed on a level concrete floor of a swimming pool and designed to be rigidly fixed from behind to adjacent pool walls. Typically, the modular step system 10 comprises a bottom step 24 closest to the floor of the swimming pool, a top step 26 closest to a surface of water at a top of the swimming pool and a middle step 28 located between the bottom step and the top step. It is understood the modular step system may include any number of steps depending on the depth of the water so long as swimmers are able to gain access to and exit the swimming pool.

Figure 7:
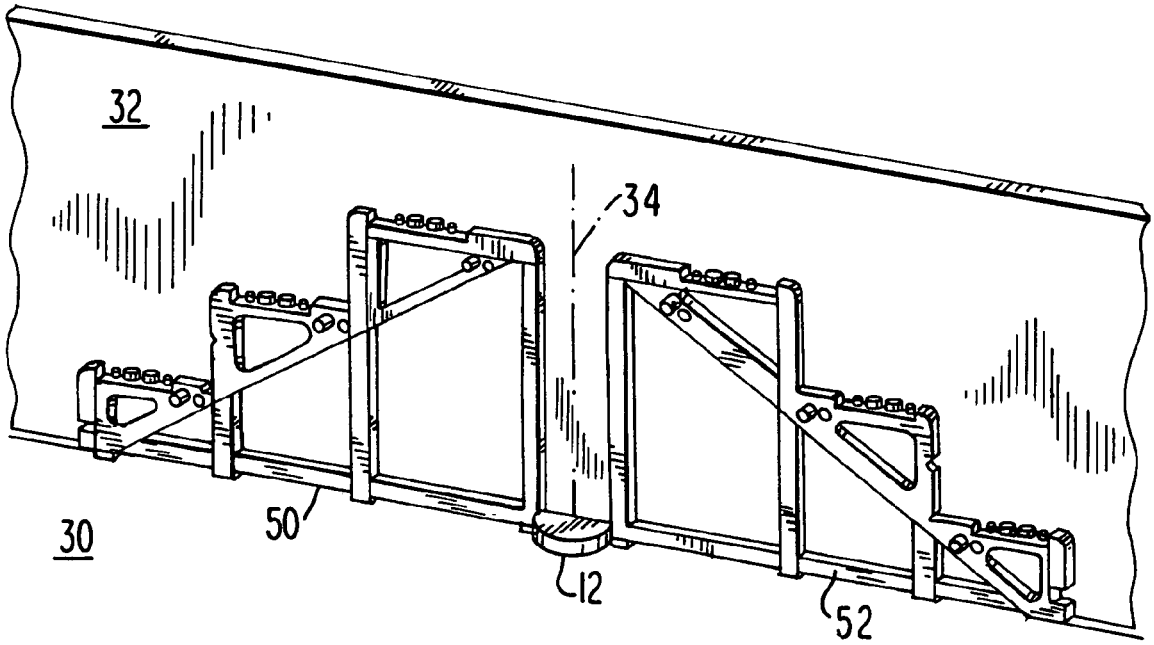
FIG. 7 is a perspective view showing a first brace and a second brace inserted into the hub of the first embodiment of the modular step system according to the present invention.

During assembly of the modular step system 10, as shown in FIGS. 1 and 7, the bottom central hub 12 is placed at an intersection of the level concrete floor 30 and a pool wall 32 of the pool, at a desired center point 34 of where the modular step system will be installed. The bottom central hub 12 is shaped like a half circle having a straight side which is placed adjacent to the pool wall. The pool wall is preferably plumb and straight. The bottom central hub 12 includes a plurality of hub notches 36 facing up for securely fastening the brace assembly described herein. The bottom central hub stabilizes and aligns the brace assembly and serves to transmit forces carried by the brace assembly into the adjacent pool wall.

Figure 2:
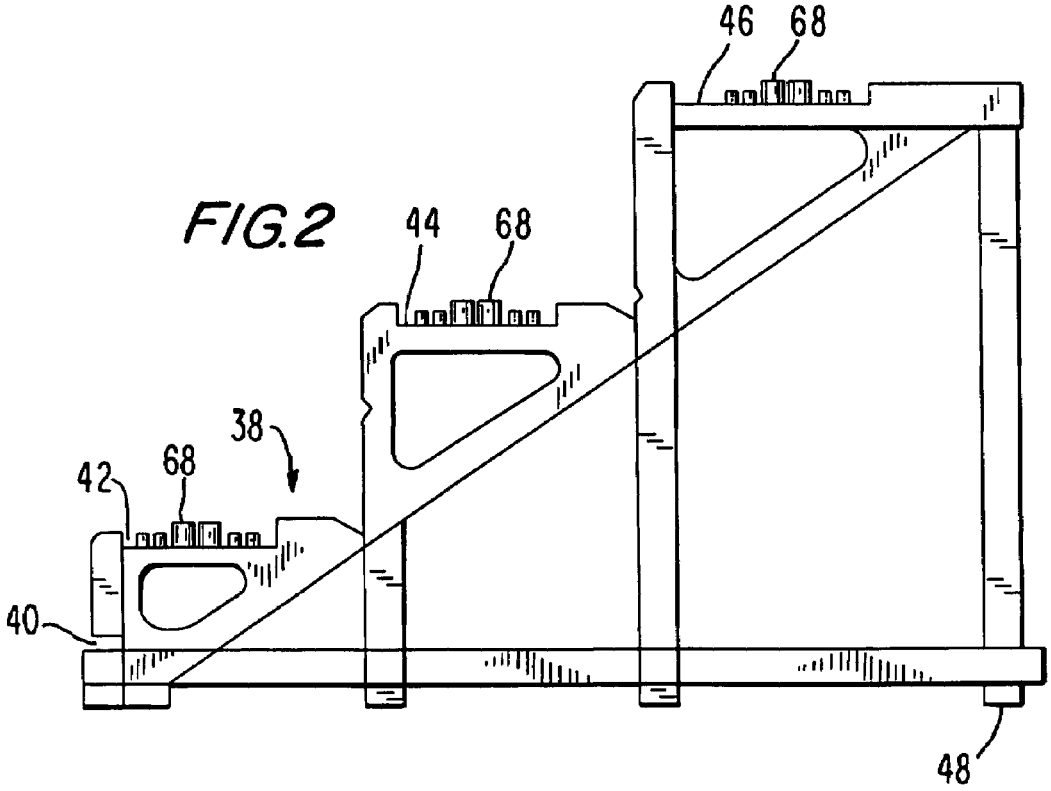
FIG. 2 a side view showing a brace of the first embodiment of the modular step system according to the present invention.
Figure 8:
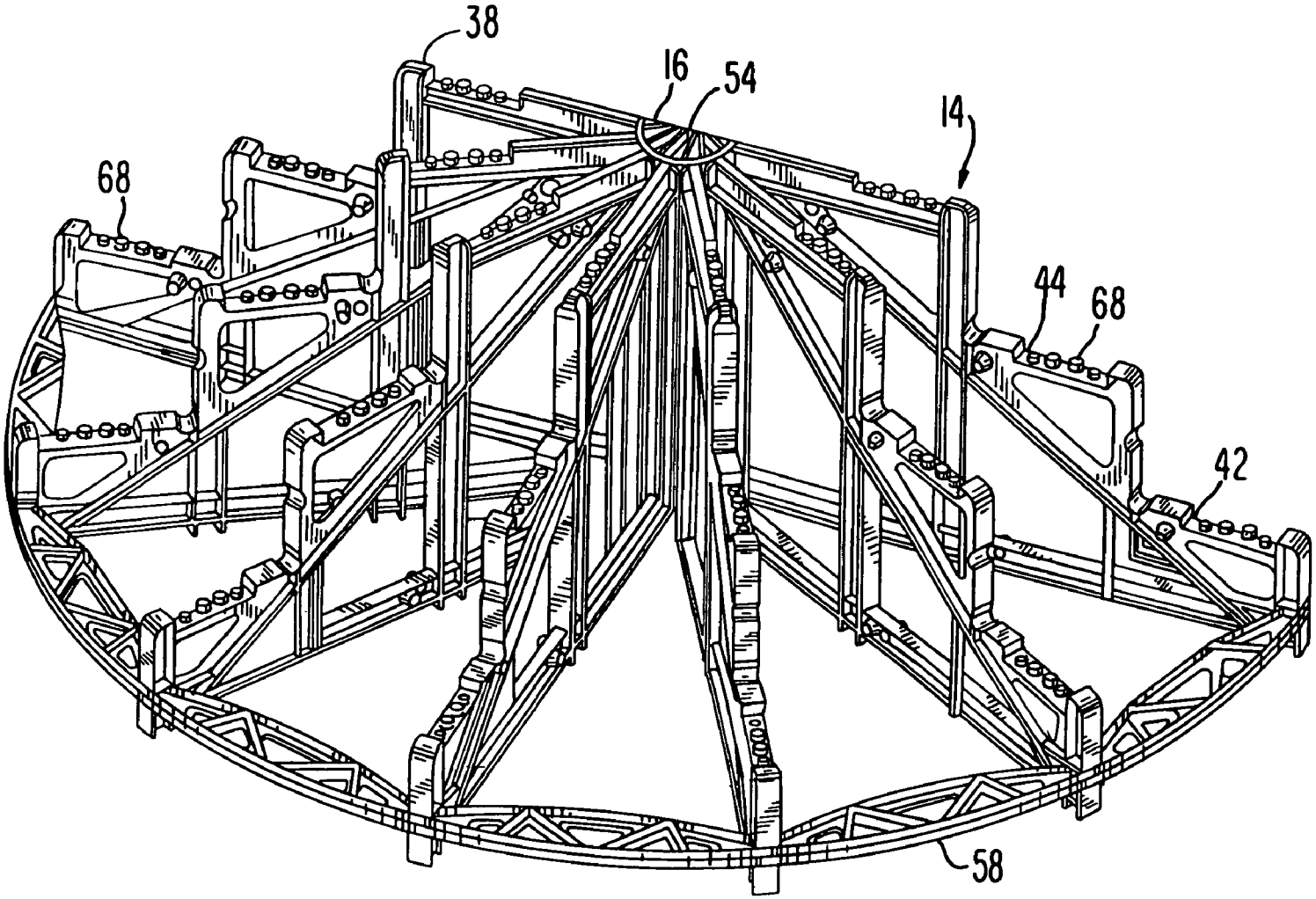
FIG. 8 is a perspective view showing a plurality of braces inserted into a top hub and a toe brace of the first embodiment of the modular step system according to the present invention.

Referring now to the brace assembly 14 shown in FIGS. 2, 7 and 8, the brace assembly 14 comprises a plurality of braces 38 which are vertical support members inserted into the bottom central hub 12. Each brace includes a bottom brace notch 40, a bottom groove 42, a middle groove 44 and a top groove 46 explained below. Each brace also includes tabs 48 for engaging the bottom central hub and the top central hub. As depicted in FIG. 7, a first brace 50 may be inserted into a hub notch of the bottom central hub 12 via a tab 48. The first brace 50 is positioned adjacent to and flush with the pool wall. Similarly, a second brace 52 may be inserted into the bottom central hub 12 via the tab at an opposite side of the bottom central hub. The second brace 52 is adjacent to and flush to the pool wall. The plurality of braces 38 may then be inserted into the bottom central hub 12 so that each hub notch engages a brace as shown in FIG. 8. It is important to ensure that the plurality of braces are supported by and in contact with the concrete floor before installing the step form as described hereinafter. The brace assembly 14 provides sufficient support to the modular step system and eliminates the need for building forms and ordering and pouring concrete. It is understood that the number of plurality of braces used may include any number of braces as long as sufficient support is provided for the modular step system 10.

Referring to FIGS. 8–10, after the plurality of braces 38 have been inserted into the bottom central hub, the top central hub 16 is placed at a top central point 54 of the plurality of braces. As explained with reference to the bottom central hub 12, tabs 56 of the plurality of braces 38 are inserted into the plurality of hub notches 36 of the top central hub 16 to create a rigid structure to support the step form. The top central hub stabilizes and aligns the brace assembly and serves to transmit forces carried by the brace assembly into the adjacent pool wall.

Figure 3:
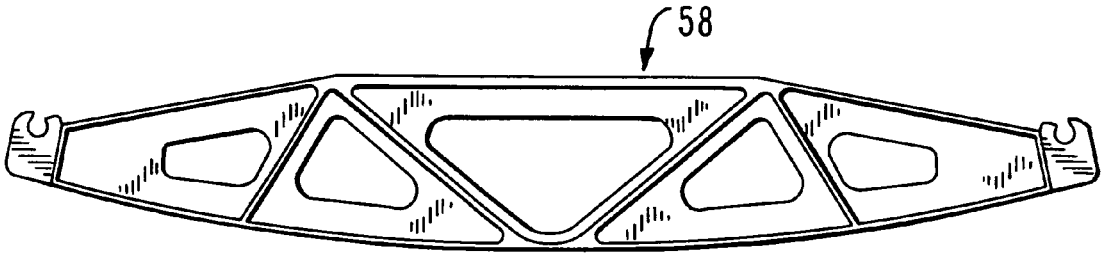
FIG. 3 is a top view showing a toe brace of the first embodiment of the modular step system according to the present invention.
Figure 4:
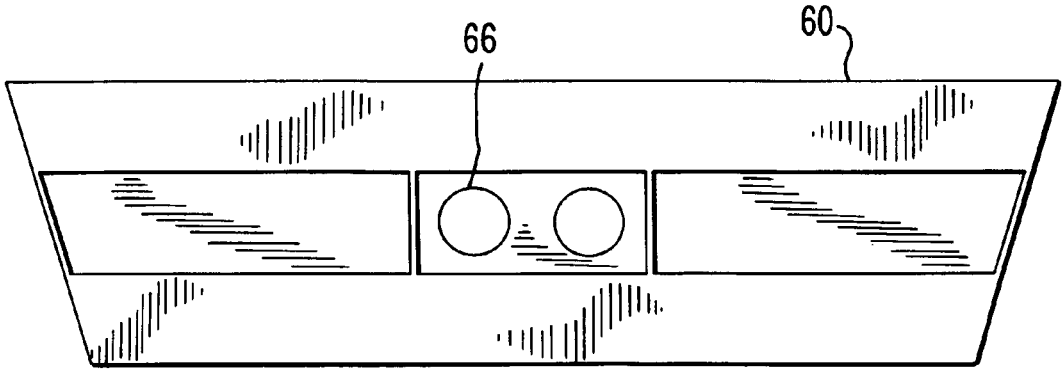
FIG. 4 is a top view showing a bottom tread of the first embodiment of the modular step system according to the present invention.
Figure 5:
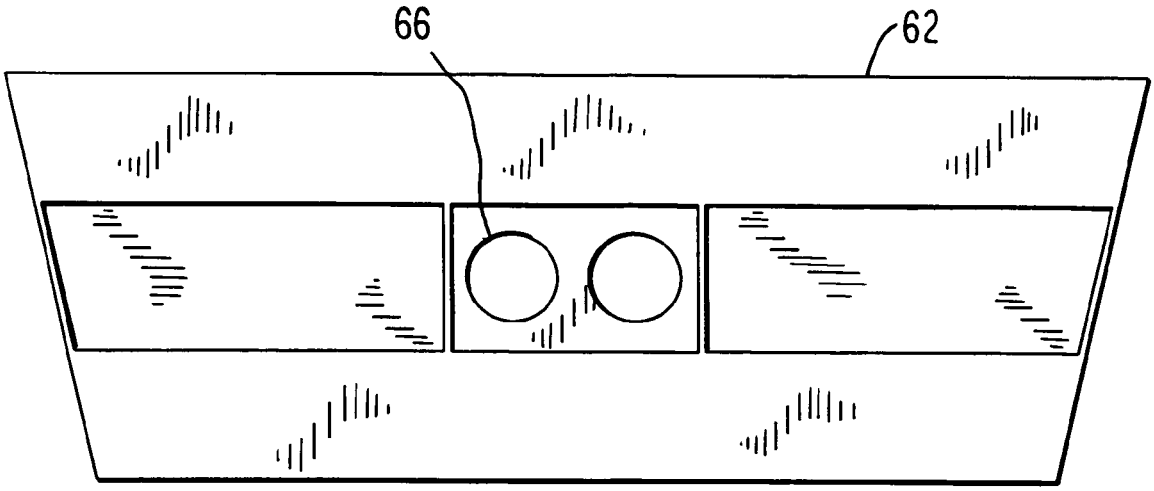
FIG. 5 is a top view showing a middle tread of the first embodiment of the modular step system according to the present invention.
Figure 6:
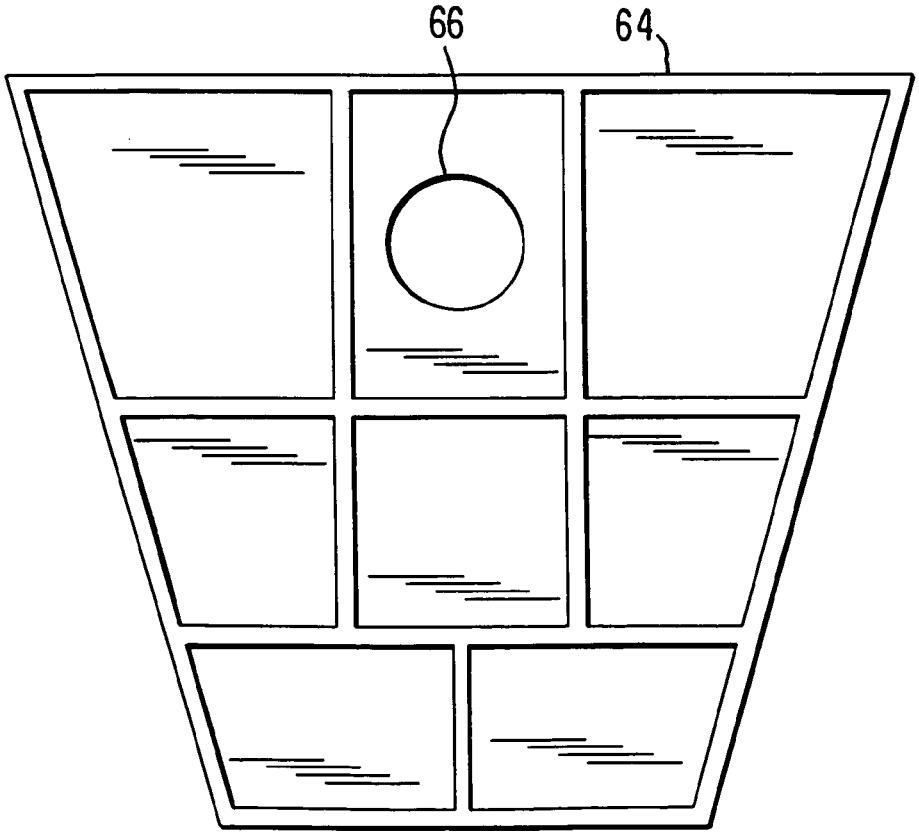
FIG. 6 is a top view showing a top tread of the first embodiment of the modular step system according to the present invention.

A plurality of toe braces 58, shown in FIGS. 3 and 8, are thereafter inserted into the bottom brace notch 40 and engage the plurality of braces 38. The toe brace 58 is a horizontal support brace which is located at the base of the modular step system 10 near the bottom step 24. The toe brace bears the water pressure force located at the bottom step of the modular step system which is transmitted into the brace assembly passing through the bottom central hub and top central hub and into the pool wall. It is understood that the middle and top steps are sufficiently rigid enough to bear the water pressure force without a support brace.

Referring to FIGS. 4–6 and 9–10, the tread support assembly 18 comprises horizontal rigid members mounted to the brace assembly 14 to secure the brace assembly into its vertical position. The tread support assembly 18 includes a bottom tread 60 (FIG. 4), a middle tread 62 (FIG. 5) and a top tread 64 (FIG. 6) and forms the bottom step 24, middle step 28 and top step 26, respectively. The bottom tread 60 is securely engaged to the bottom groove 42 via openings 66 which mate with posts 68 (FIG. 2), respectively, on the bottom groove of the tread. Similarly, the middle tread 62 is engaged to the middle groove 44 and the top tread 64 is engaged to the top groove 46 in the same manner. The tread support assembly carries the downward vertical forces of water in the swimming pool and of a swimmer on the modular step system, thereby transferring the forces to the brace assembly and onto the floor of the swimming pool. It is understood that three treads are preferably used in the present invention, however any number of treads may be used depending on the desired number of steps. It is also understood that any method may be used to secure the treads to the grooves such as openings in alignment with mating tabs, pins, protrusions, or fasteners.

Referring to FIGS. 10 to 12, the step form 20 is placed over the structure comprising the bottom central hub 12, the brace assembly 14, the top central hub 16, the tread support assembly 18, and the toe brace 58. The step form 20 is preferably made of a molded plastic material or curing of a curable material and produced from a fixed mold. It is understood that the thickness of the step form must be sufficiently thick to provide adequate structural strength in conjunction with the brace and tread support system. The step form 20 is molded with a textured pattern 70 in the tread assembly area (i.e. on the steps) creating a non-slipping surface to reduce slipping on the modular step system 10.

The step form 20 must be fully seated against the pool wall, the concrete floor, and have a close fit with the brace assembly 14 and the tread support assembly. Preferably, the brace assembly 14 may stand away from the wall a small distance (i.e. approximately ¼) allowing for the step form 20 to be retained behind edges of the brace assembly. The close fit ensures that the forces from the water pressure and the swimmers weight are transferred directly from the step form to the brace assembly and the tread support assembly through points where the components contact each other. As previously described, the force is then transferred to the pool wall and concrete floor.

As shown in FIG. 11, the step form 20 may be covered with the liner 22 preferably made of vinyl. The liner 22 is fabricated and placed over the step form in conformance with the appearance of the vinyl liner in the swimming pool. By creating the step form from a fixed mold, the liner consistently fits the structure, without the need for adjusting and re-measuring the step. The textured pattern 70 of the step form 20 engages and presses through the liner 22 so that the liner also includes a textured pattern, thereby reducing the slippery surface of the smooth vinyl when it is covered by water and stepped on by a swimmer. It is understood that the thickness of the vinyl must be sufficiently thick to prevent puncture and leakage of water into the modular step system.

During installation of the modular step system 10, it is understood that a leveling grout or mortar may be used if there are variations in the floor level of the swimming pool. Furthermore, it may be preferable to grind one or more of the interior braces legs or the bottom center hub to better conform to small irregularities of the floor. However, it is understood that the outer braces should not be shortened as shortening will cause the step form to touch the floor instead of rest on the braces resulting in possible warping or collapse of the modular step system.

Figure 13:
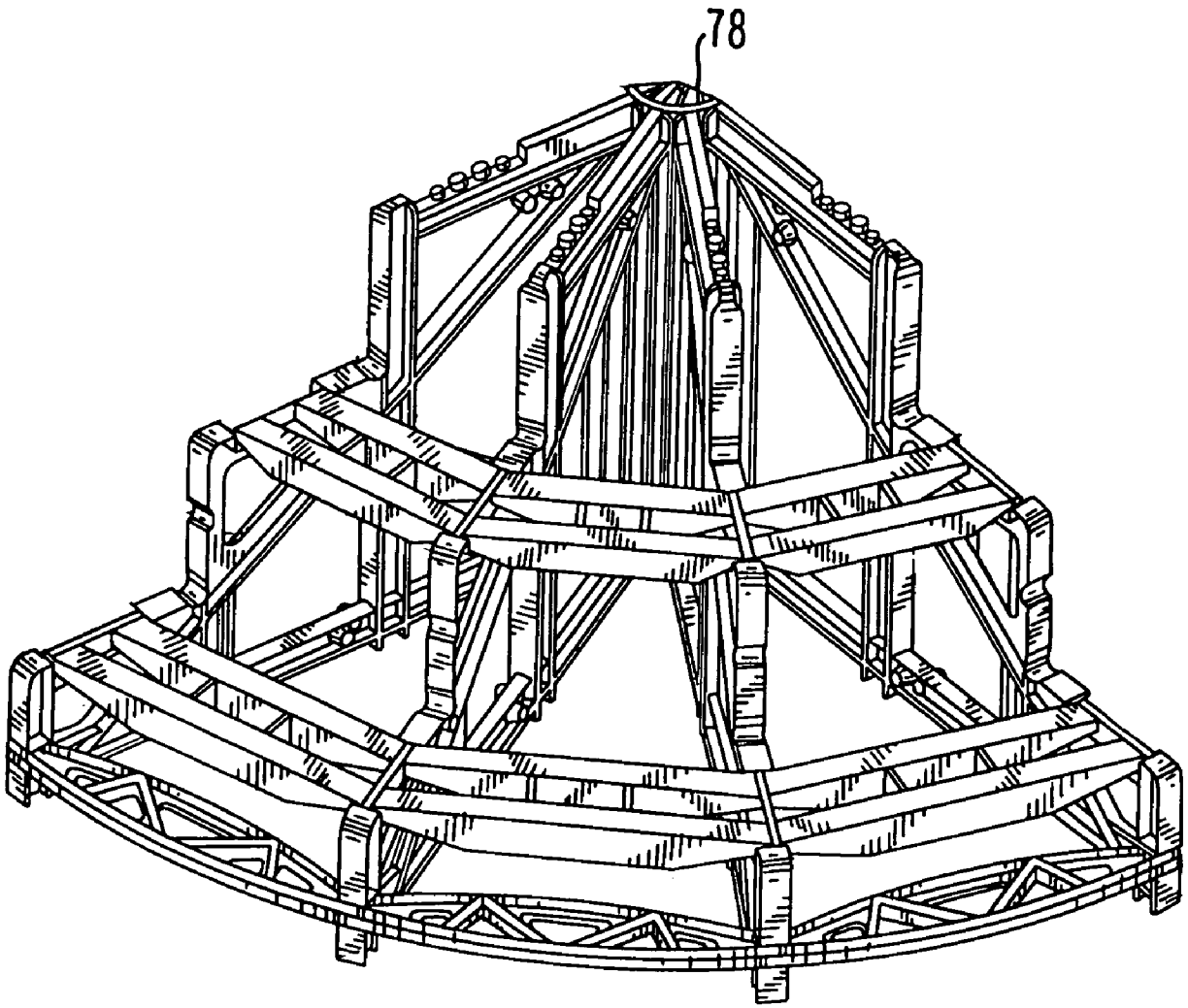
FIG. 13 is a perspective view showing a plurality of braces inserted into a top corner hub with the toe brace, the bottom tread and the middle tread secured to the plurality of braces of a second embodiment of the modular step system according to the present invention.
Figure 14:
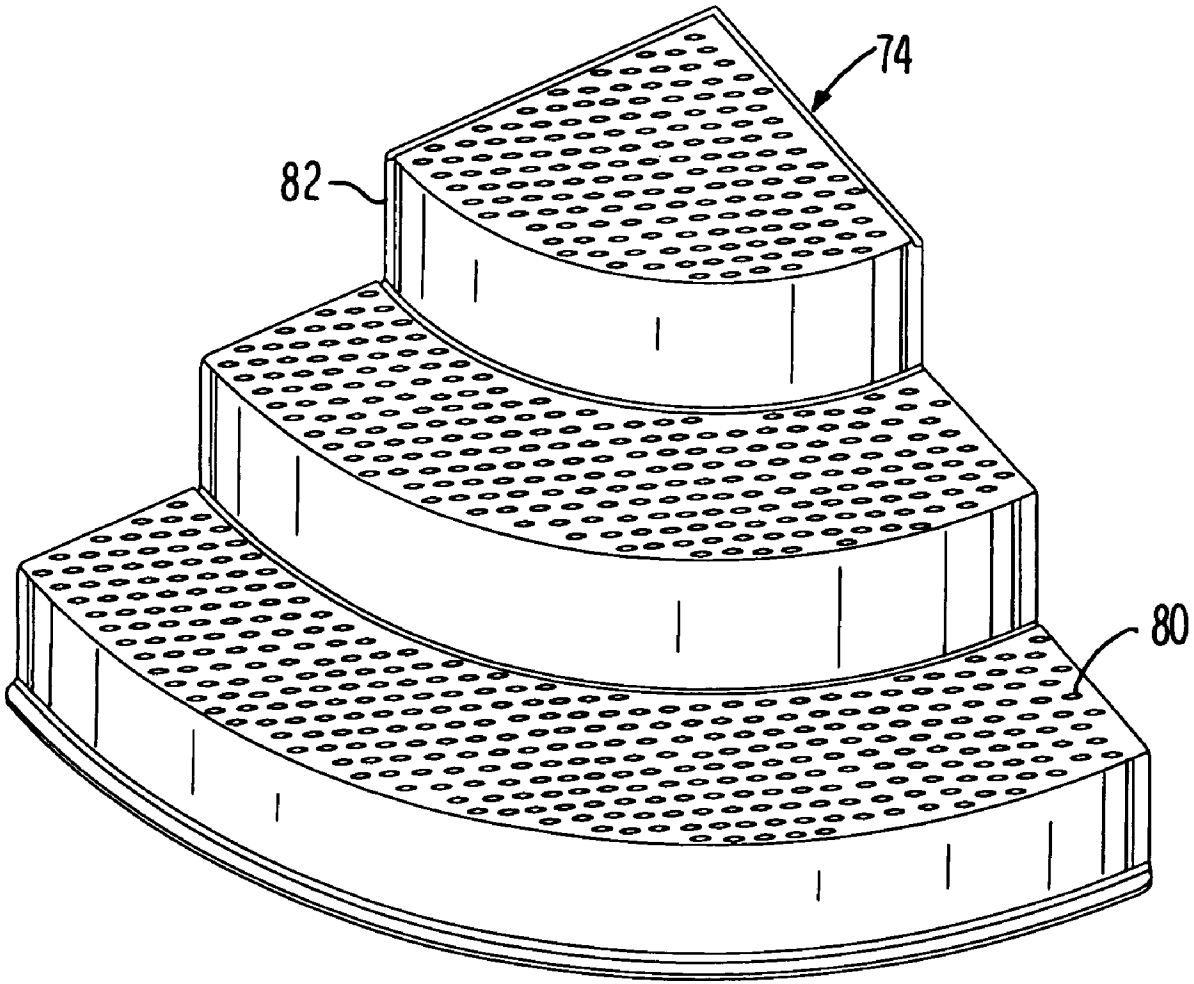
FIG. 14 is a perspective view showing a step form of the second embodiment of the modular step system according to the present invention.

A second embodiment of the modular step system 74, shown in FIGS. 13 and 14, is designed to be placed in a pool corner, preferably a 90-degree pool corner. During assembly of the second embodiment of the modular step system 74, a bottom corner hub 76 having a 90-degree corner is placed in the pool corner with the plurality of hub notches facing up. Similar to the first embodiment, a plurality of braces having tabs are inserted into the hub notches and a top corner hub 78 is placed at the top central point of the plurality of braces. The toe brace, the tread support assembly and the toe edge are installed in the same manner as the first embodiment.

As shown in FIG. 14, a corner step form 80 comprises 90-degrees and fits snugly with the pool walls forming the 90 degree corner. A corner liner 82 may be placed over the corner step form 80. The modular step system may be rigidly fixed from behind to the pool walls at the corner. It is understood that the present invention is not limited to 90-degree pool corners and may be used in corners having greater than or less than 90-degrees.

Figure 15:
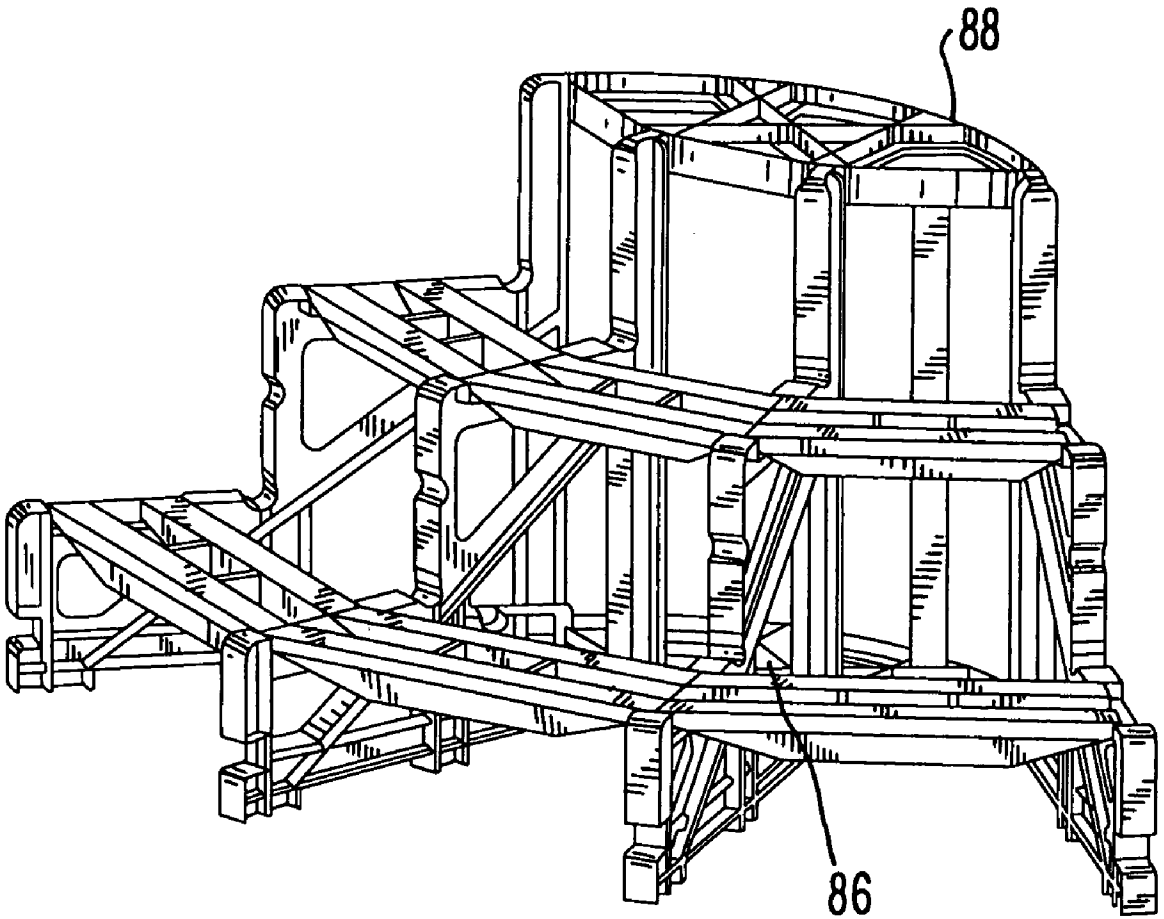
FIG. 15 is a perspective view showing a plurality of braces inserted into a top convex hub with the bottom tread and the middle tread secured to the plurality of braces of a third embodiment of the modular step system according to the present invention.
Figure 16:
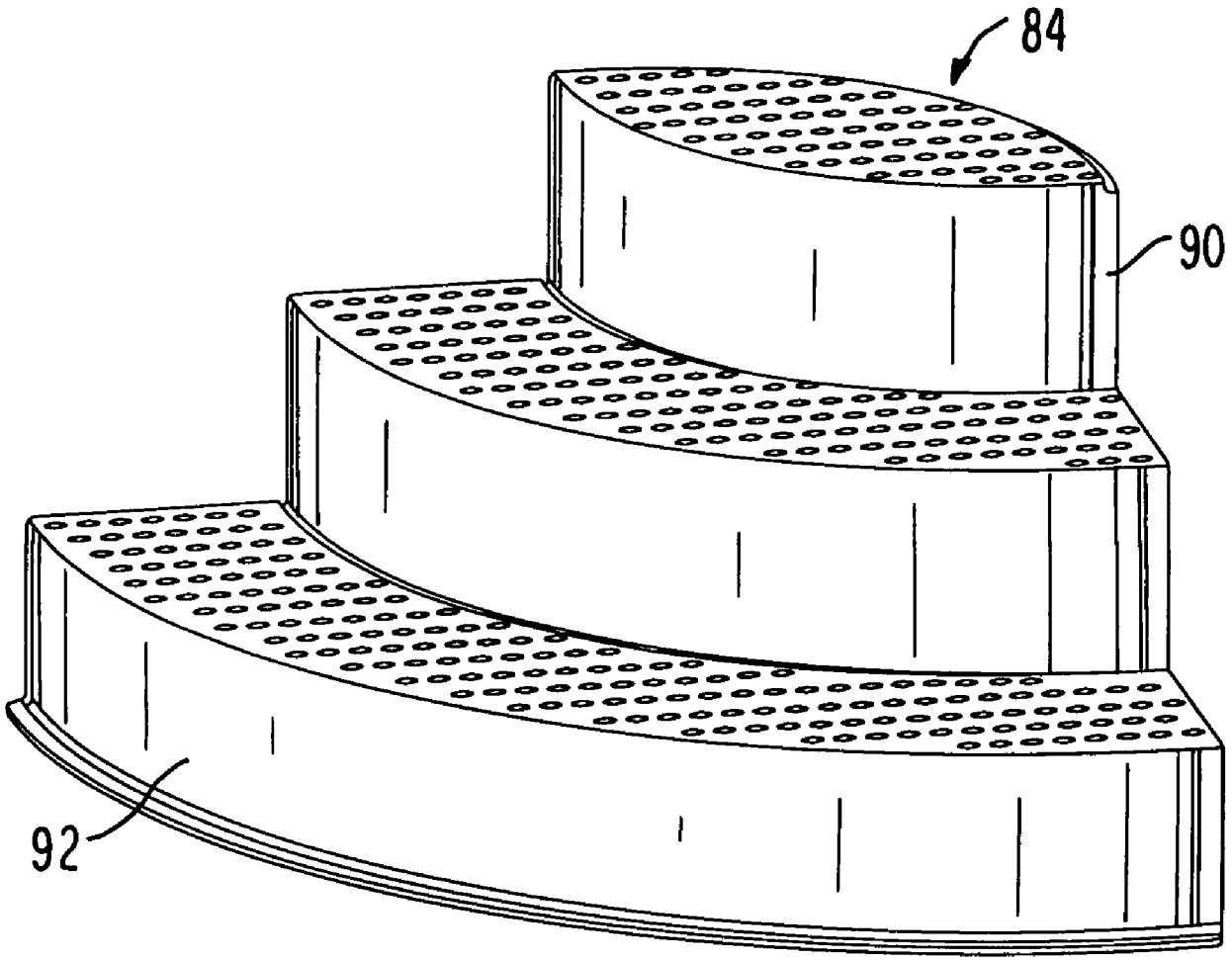
FIG. 16 is a perspective view showing a step form of the third embodiment of the modular step system according to the present invention.

A third embodiment of the modular step system 84, shown in FIGS. 15 and 16, is designed to be placed adjacent to a pool wall having a concave curve. During assembly of the third embodiment of the modular step system 84, a bottom convex hub 86, also preferably like a football-shaped platform, is placed adjacent to the concave curve of the pool with the plurality of hub notches facing up. Similar to the first embodiment, a plurality of braces having tabs are inserted into the hub notches and a top convex hub 88, preferably like a football-shaped platform, is placed at the top central point of the plurality of braces. Different from the first embodiment, the top convex hub 88 replaces the top tread and serves as the top step. The toe brace, the tread support assembly and the toe edge are installed in the same manner as the first embodiment.

As shown in FIG. 16, a convex step form 90 is placed adjacent to the concave pool wall and fits snugly with the pool wall. A convex corner liner 92 may be placed over the corner step form 90. The modular step system 84 will be rigidly fixed from behind to the pool wall. It is understood that the present invention is not limited to the shape described and may be used with a pool wall having a convex or concave curve of any degree or shape as long as the pool wall and modular step system have conforming curves.

The components of the modular step system described herein with reference to FIGS. 1 to 16 are molded, therefore, the step form is consistent in size and shape making it possible to consistently produce standard step forms and liners that conform to the step form. It is understood that the support system components are obtained by molding plastic material or curing of a curable material. Since concrete is not necessary to produce the steps, the steps may be installed efficiently and saves the time consuming process of building a form and pouring concrete by a skilled workman. Furthermore, because the components for the modular step system interlock and snap together without fasteners or other complicated connections, the time necessary to assemble the steps is greatly reduced and minimal training or skill is required to properly install the steps.

Although the modular step system is shown in FIGS. 1 to 16 for use with an in-ground swimming pool, it is understood and within the scope of the present invention that the modular step system may be fabricated for use with pools having other shapes requiring a step area. Furthermore, the modular step system may be fabricated for all vinyl liner pools whether constructed with steel, polymer, fiberglass, wood, or concrete. It is also understood that the modular step system may be used with pools having multiple step areas. Moreover, it is understood that the features of the present invention may be used for other purposes such as steps in a hot tub or spa, or as a seating area or the like.

What is claimed is:

1. A modular step system for in-ground swimming pools comprising:

a bottom central hub;

a brace assembly, comprising a plurality of braces mounted to said bottom central hub, said braces structured and arranged to form at least one step;

a top central hub, secured to a top central point of said plurality of braces;

a tread support assembly, comprising at least one horizontal rigid member mounted to said brace assembly at each of said at least one step;

a step form placed over said components; and a liner placed over said step form.

2. The modular step system of claim 1 wherein said modular step system is rigidly affixed from behind to a pool wall.

3. The modular step system of claim 1, wherein said components interlock and snap together without fasteners.

4. The modular step system of claim 1, wherein said bottom central hub is placed at an intersection of a pool wall and a pool floor at a desired center point of where said modular step system will be installed.

5. The modular step system of claim 1, wherein said bottom central hub is shaped like a half circle having a straight side.

6. The modular step system of claim 1, wherein said bottom central hub further comprising a plurality of hub notches structured and arranged to securely fasten said brace assembly.

7. The modular step system of claim 1, wherein said plurality of braces are vertical support members.

8. The modular step system of claim 1, wherein said plurality of braces further comprise a plurality of tabs structured and arranged to engage said bottom central hub and said top central hub.

9. The modular step system of claim 1 further comprising at least one toe brace mounted to said brace assembly at the base of said modular step system.

10. The modular step system of claim 1, wherein said brace assembly further comprising a plurality of grooves and said tread support assembly further comprising a plurality of posts, and wherein said posts are structured and arranged to engage said posts.

11. The modular step system of claim 1, wherein said step form is made of a molded plastic material.

12. The modular step system of claim 1, wherein said step form is made by curing a curable material.

13. The modular step system of claim 1, wherein said step form is produced from a fixed mold.

14. The modular step system of claim 1, wherein said step form is molded with a textured pattern to reduce slipping.

15. The modular step system of claim 1, wherein said liner is made of vinyl.

16. The modular step system of claim 1, wherein said liner is sufficiently thick so as to prevent puncture and leakage of water into said modular step system.

17. A modular step system for a pool corner, comprising:

a bottom corner hub a brace assembly, comprising a plurality of braces mounted to said bottom corner hub, said braces structured and arranged to form at least one step;

a top corner hub, secured to a top central point of said plurality of braces;

a tread support assembly, comprising at least one horizontal rigid member mounted to said brace assembly at each of said at least one step;

a corner step form placed over said components; and a liner placed over said step form.

18. The modular step system of claim 17, wherein said bottom corner hub has a 90-degree corner.

19. A modular step system for a pool wall having a concave curve, comprising:

a bottom convex hub;

a brace assembly, comprising a plurality of braces mounted to said bottom convex hub, said braces structured and arranged to form at least one step;

a top convex hub, secured to a top central point of said plurality of braces;

a tread support assembly, comprising at least one horizontal rigid member mounted to said brace assembly at each of said at least one step;

a step form placed over said components; and a liner placed over said step form.

* * * * *